US006318107B1

(12) United States Patent
Pandaru et al.

(10) Patent No.: US 6,318,107 B1
(45) Date of Patent: Nov. 20, 2001

(54) ADVANCED DEFROST SYSTEM

(75) Inventors: Constantin Pandaru, Bucharest (RO); John Wilson, Hi Ceder-Helotes, TX (US)

(73) Assignee: D. S. Inc. (Defrost Systems Inc.), San Antonio, TX (US)

( * ) Notice: Subject to any disclaimer, the term of this patent is extended or adjusted under 35 U.S.C. 154(b) by 0 days.

(21) Appl. No.: 09/567,514

(22) Filed: May 9, 2000

Related U.S. Application Data

(60) Provisional application No. 60/139,218, filed on Jun. 15, 1999.

(51) Int. Cl.[7] ..... F25B 47/00
(52) U.S. Cl. ..... 62/277; 62/276; 62/118
(58) Field of Search ..... 62/276, 277, 118, 62/158

(56) References Cited

U.S. PATENT DOCUMENTS 3,681,934 * 8/1972 Tudury ..... 62/156
4,043,144 * 8/1977 Klotz et al. ..... 62/277

FOREIGN PATENT DOCUMENTS 3-241277 A * 10/1991 (JP) ..... 62/276

* cited by examiner

*Primary Examiner*—Henry Bennett
*Assistant Examiner*—Melvin Jones
(74) *Attorney, Agent, or Firm*—Defrost Systems Inc.

(57) ABSTRACT

A device that includes two heat exchangers, one attached to the ambient or to the hot parts of the refrigeration unit including a reservoir filled with high sensible heat liquid and the other attached to the evaporator of the unit, a closed loop circuit between the two heat exchangers and a pump that can circulate the liquid during defrost cycle, providing a controllable, intensive heat transfer from the warmed liquid to the evaporator coil in order to melt the frost deposits.

3 Claims, 4 Drawing Sheets

ADVANCED DEFROST SYSTEM

This application claims benefit of Prov. No. 60/139,218 filed Jun. 15, 1999.

BACKGROUND OF THE INVENTION

1. Field of the Invention

The present invention relates generally to devices and methods for defrosting of the cold sides of the refrigeration units. The present invention relates more specifically to the structure and composition of a device to rapidly and controllably defrost the evaporators and other under freezing sides of the refrigeration or heat pumping units using waste energy rather than added energy.

2. Description of the Related Art

The frost deposit on the evaporators represents a natural and unwanted phenomenon. In refrigeration and deep freezing units during the cooling cycle time the evaporator reaches lower temperatures than the freezing point of water, (0° C.), so, the frost, that is deposed will lower the overall efficiency of the units due to the thermal resistance of the snow-like deposits. It is well known that the frost deposit cannot be avoided because the water vapors are always present in the air infiltrating the unit. Realistically it can be said that most of the time the evaporators are covered with some unwanted frost which directly increases the energy required to keep the temperature of the refrigeration unit within necessary limits.

There have been a number of attempts to create devices and methods for an intermittent defrost cycle. The most commonly used device is based on an electric resistance heater, which is placed nearby the evaporator. The heat produced is used to melt the frost and the resulting water is collected and guided out of the system. The undesirable characteristic of this method is the relatively long time necessary to defrost because of the poor heat transfer (free convection of the air) from the electrical resistor to the evaporator coils. The residual heat in the evaporator space after defrost will increase the input energy necessary to regain the temperature needed inside the refrigeration unit. Usually the signal for defrost cycle is received from a sensor mounted directly on the evaporator which can measure the temperature drop of the evaporator due to the frost deposit. The temperature drop is directly influenced by the thickness of the frost.

Other defrost devices replaced the well-known electrical resistor with an infrared heater. The resistor wire is encased in a quartz glass tube and its operating temperature is set at red-orange color. The infrared radiation is reflected by the walls of the evaporator space and when they reach the evaporator, the thermal effect will melt the frost. This kind of infrared generator is mostly used when the evaporator is placed horizontally and free air connection cannot be used properly. The disadvantage of this approach is due to poor absorption of the infrared radiation by the frost, which is white and therefore reflective. The time necessary for defrost will thus be increased and the residual heat within the evaporator space is increased.

Another method for defrosting is the "reversed cycle" technique. Mostly used for larger units, the idea is based on in reversing the circulation of the refrigerant fluid inside the refrigeration system. In this way the evaporator will become the condenser and will receive hot, pressurized refrigerant from the compressor. The heat dissipated by the pressurized refrigerant is used to melt the frost. The "reversed cycle" or defrost cycle is achieved by solenoid valves that reverse the usual circulation of the refrigerant The valves are activated by the defrost sensor, as it was previously mentioned. The disadvantages of such a system are obvious: more moving parts within pressurized pipes should decrease the reliability, and the thickness of the evaporator walls must be increased to comply with the pressurized side requirements. As a result the thermal resistance of the evaporator will increase and the thermal transfer between the refrigerant and the air will decrease; so, the coefficient of performance (C.O.P) of the system will be lower than that of a classic unit.

The above existing devices and methods for defrost were developed in order to increase the efficiency of the refrigeration units. Energy savings represent a stringent requirement for all fields; global warning and the related aspects represent a global concern. High-energy efficiency appliances are required to be developed as part of the energy saving effort. Refrigeration systems of all kind represent one of the most important energy consumers.

SUMMARY OF THE INVENTION

It is desirable to have devices and methods for refrigeration defrost that consume as little energy as possible, and use as few moving parts as possible. It is desirable that the energy required could be applied directly on the evaporator pipes in order to avoid residual heat inside the evaporator space. It is desirable that the devices can be easily adapted to the existing designs, for any kind of refrigeration unit: all sizes of freezer-refrigerators, food cabinets, fresh food isle, large walk-in warehouses, etc.

One primary element of the devices and methods of the present invention is the preferred use of thermal energy stored in a liquid, which by forced convection will raise the temperature of the evaporator and will melt the frost during defrost cycle. The liquid does not reach the high temperature of a resistance element. For this purpose a designated circuit of liquid should be used.

The second-element of the devices and methods of the present invention refers to the preferred design, materials and construction of the warm liquid circuit in order to optimize the overall efficiency of the refrigeration system equipped with the new proposed defrost device.

In general, the better efficiency of the new concept developed by the present invention is the difference between the quantity of thermal energy generated inside the refrigeration units for defrost on existing designs and the energy needed only to circulate (forced convection) the warm fluid from the outside reservoir, in order to dissipate its thermal energy on the evaporator coil (the intend of the present invention).

The thermal energy of the fluid is acquired the heat dissipated by the condenser. In both cases the thermal energy used for defrosting the evaporator is a "free of charge energy". The basic intent of the invention is to implement the new devices and methods that can achieve the usage of the "free of charge" thermal energy for defrosting and to diminish the necessary energy for forced convection thermal transfer from the warm fluid to the evaporator coils.

As a conclusion, this invention recaptures part of the waste heat that is normally rejected from the condensing coil and stores it in a high specific heat liquid. When the defrost cycle is required, the liquid is circulated through the evaporator coil chamber and the frost is melted with new energy that would normally be wasted, instead of being melted with new energy that is required from the power supply. The only outside energy used is the tiny amount required to run the circulation pump.

The existing electrical elements require a longer time to defrost because they are at higher temperature, but essentially a point source, so that by time the perimeters of the coil are defrosted, the center area of the evaporator chamber is heated to a very high level and this must be removed by the refrigeration cycle.

This invention, because it uses a lower temperature warming source that is evenly distributed throughout the coil chamber, melts the frost deposits faster without raising any part of the chamber higher than the others, therefore reducing the residual defrost heat that must be removed by the refrigeration cycle.

In summary, this invention reduces the energy consumed by the refrigeration unit in two ways:

1. It uses "free" energy that is rejected by the refrigeration cycle for defrost
2. It reduces the load on the refrigeration cycle caused by the defrost cycle because it causes less heating of the evaporator coil chamber.

It is also anticipated that the same goals can be achieved by a simplified arrangement (see FIG. 7) in which the thermal reservoir is warmed only by the ambient: fins and enlarged surface of thermal contact between the reservoir and ambient should be preferred. The necessary quantity of thermal energy should be adjusted by an increased volume of the liquid in order to reach the optimum product $m\text{-}c\text{-}\Delta T$, where:

m represents the mass of the liquid c represents the sensible heat of the liquid $\Delta T$ represents the gradient that enables the thermal transfer from the liquid to the evaporator coil for defrost. It is obvious that in this case the reservoir's walls must provide high thermal conductivity and enlarged surface, similar construction with the air-liquid exchanger (thin walls, aluminum or copper tubes, fins).

It is also anticipated that the working liquid can be warmed not only by the condenser coil but by any other hot part of the refrigeration unit; the preferred choices can be the compressor head, the compressor casing or the compressor lubricant. An interesting arrangement could use directly the compressor lubricant fluid to melt the frost deposit via evaporator heat exchanger during defrost cycle. Using this simplified arrangement two goals can be achieved: no new liquid agent should be needed and the frequent cooling of the lubricant can enhance the compressor operational lifetime.

It is obvious that the preferred arrangement should take into consideration the specific requirements for the field concerned:

home appliances transportation purposes large refrigeration units for food industry.

DETAILED DESCRIPTION OF THE PREFERRED EMBODIMENT

Figure 3:
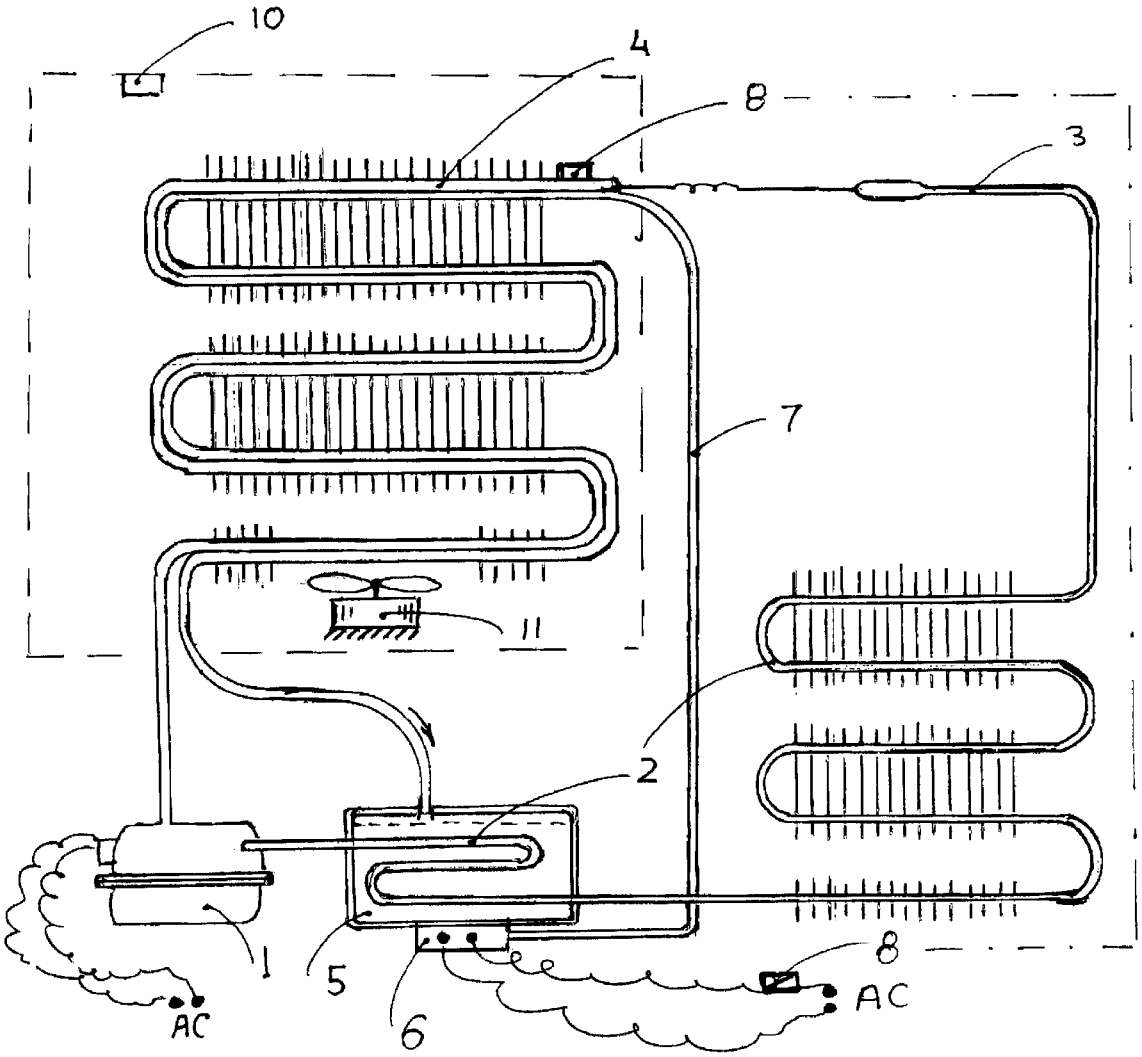
FIG. 3 is a schematic presentation of the device subject of the present invention and the typical arrangement of a refrigeration unit that incorporates the proposed device.

See FIG. 3 for a detailed description of the primary elements of this present invention.

FIG. 3 is a schematic presentation of the advanced defrost system, subject to the present invention and a typical arrangement of a refrigeration unit that incorporates the new system. The system comprises a reservoir (5) which contains a working liquid, a pump (6) activated by the defrost sensor (8) and a circuit (7) that allows the warmed liquid to reach the evaporator coil in order to transfer its sensible heat to the evaporator metallic structure. The purpose of the thermal transfer from the liquid to the evaporator is to raise the temperature of the metallic structure of the evaporator, the melting of the frost and the evacuation of the resulting water.

The refrigerator unit is represented by its main components: the compressor (1) that pushes the compressed refrigerant vapors to the condenser coil (2) where the vapors dissipate their heat to the ambient and should condense, the capillary tube (3) or expansion valve that regulates the flow and pressure of the refrigerant liquid that discharges to the evaporator (4). Within the evaporator the refrigerator liquid vaporizes, absorbing the heat from inner space air of the refrigeration unit. The saturated vapors return to the compressor at low pressure, being absorbed via inlet valve and thus the refrigeration cycle continues until the necessary temperature inside the unit is reached; then the thermostat (10) should disengage the compressor.

Figure 4:
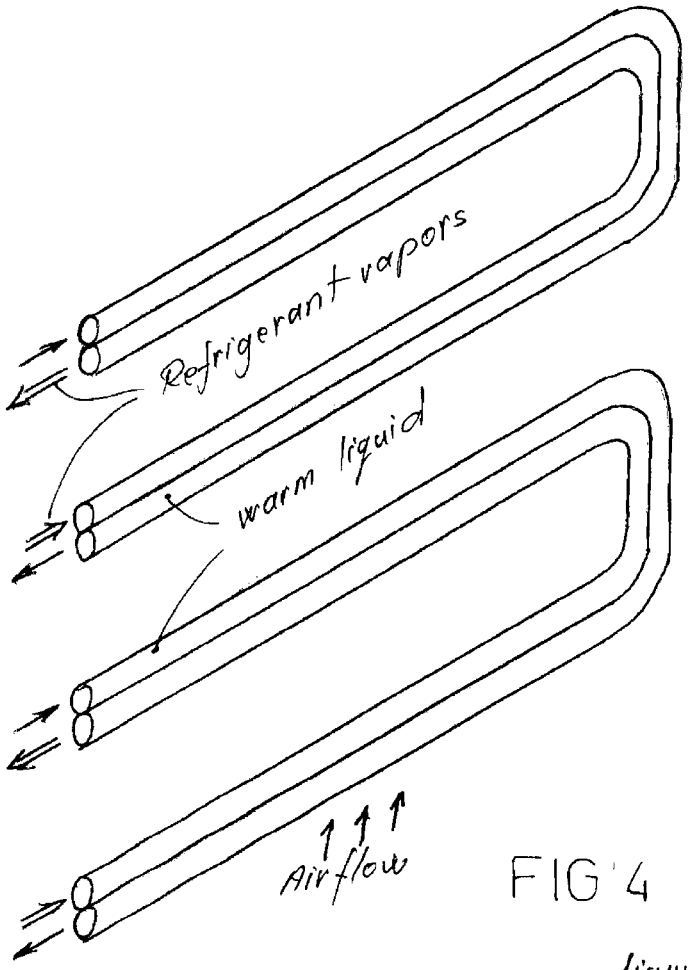
FIG. 4 is a detail of construction showing the typical vertical evaporator with the proposed new defrost circuit.

The mission of the defrost sensor is to engage the pump of the advanced defrost system while the compressor is stopped and the temperature of the evaporator has reached a lower temperature than the designed limitations. The state of the art shows that a lower temperature of the evaporator is due to an increased thermal resistance between the refrigerant and the inner space air: this unwanted thermal resistance is the frost deposit. The defrost cycle starts for the existing defrost system when the compressor is disengaged by the thermostat (10) and when the defrost sensor (8) activates the pump via defrost timer (8'). The pump should circulate the warmed liquid which should dissipate its sensible heat directly to the evaporator coil; FIG. 4 shows a typical arrangement in which a direct metal to metal thermal contact is provided in order to facilitate the thermal transfer from the fluid to the evaporator coil.

It is to mentioned that the main difference between the existing defrost systems and the advanced defrost system, the subject of the present invention, is the nature of the thermal energy used for defrost.

Figure 1:
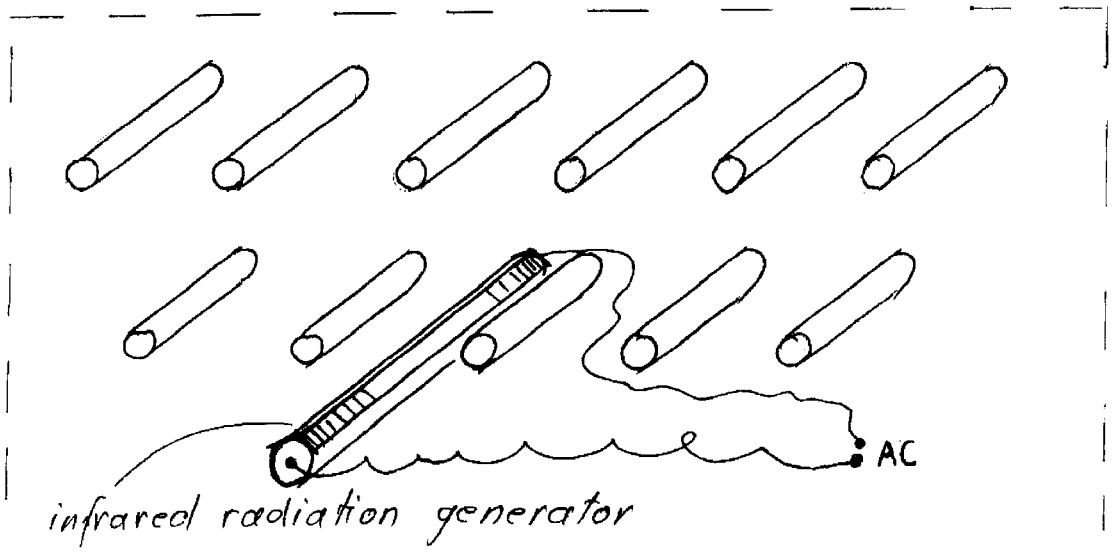
FIG. 1 is a typical construction of a horizontal evaporator showing the position of the defrost element; infrared generator (1) used in existing designs.
Figure 2:
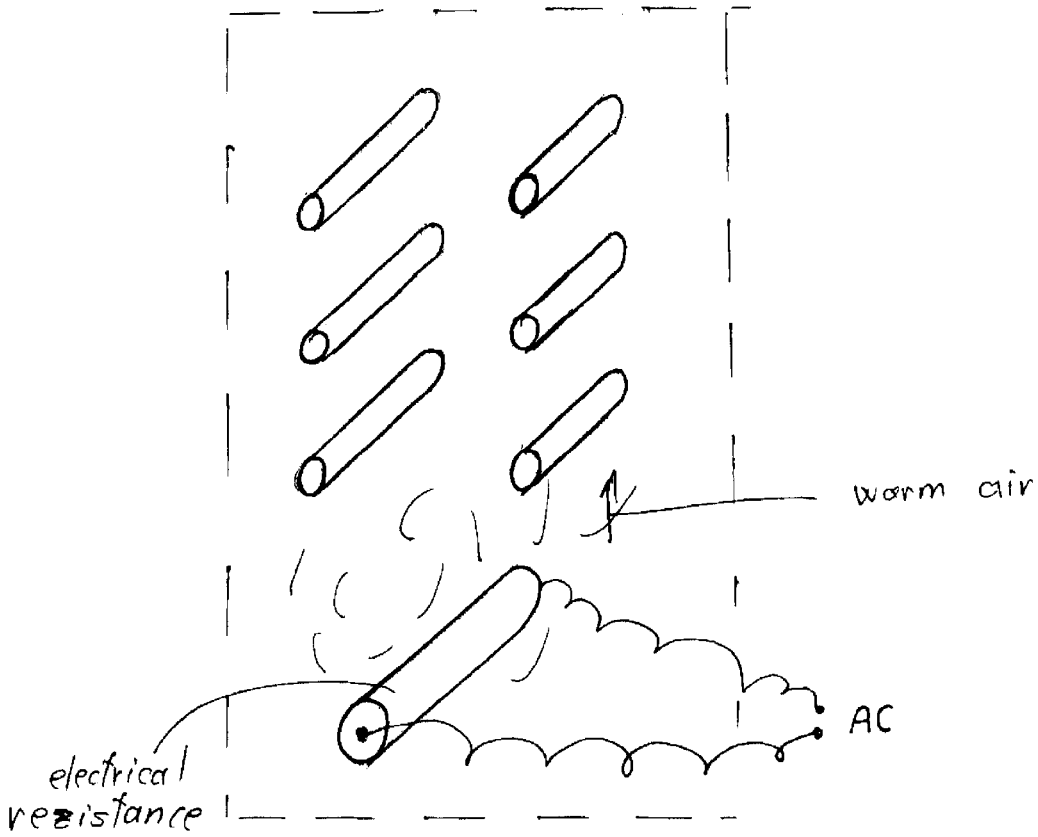
FIG. 2 is a typical construction of a vertical shape evaporator showing the position of the defrost electrical resistor (1) used in existing designs.

Thus, the existing devices generate thermal energy by converting the electrical energy, which feeds an electrical resistor. Both examples presented in FIG. 1 and FIG. 2 use additional electrical energy for defrost. For the reversed cycle defrost system the additional electrical energy is needed as well.

The advanced defrost system, the subject of the present invention, uses "free" thermal energy for defrost. So, the liquid from the reservoir (5) (see FIG. 3) gains sensible heat from the pressurized hot refrigerant vapors which are guided from the compressor outlet to a coil-heat exchanger immersed into the working liquid and the condenser (2) (see FIG. 3) should dissipate only the remaining heat to the ambient.

While the compressor is running (engaged) the liquid will gain sensible heat and can reach almost the same temperature as the pressurized vapors.(55° C.–70° C.).

The energy accumulated is important and suffices for defrost because both the gradient and the quantity of accumulated thermal energy reach the necessary parameters for the intended thermal transfer to the evaporator. It is also to be mentioned that the only additional energy for the new system is represented by the energy needed to circulate the liquid in order to achieve the forced convection from the reservoir to the evaporator. It is anticipated that the amount of energy needed by the pump to perform the forced convection should not exceed 15% of the thermal energy transferred to the evaporator coil.

Another advantage of the new proposed system resides in the construction (FIG. 4) which shows that the available thermal energy should be provided locally, evenly distributed on the evaporator coil. In this way the evaporator's metallic walls should receive only the amount of energy needed for defrost. The hot spots should never be present and the internal space should not raise unnecessarily its temperature. The thermal energy should be provided only to the evaporator coil directly, using metal to metal thermal conductivity. In this way the thermal resistance between the evaporator coil and the working liquid reaches the minimum. At the same time, both circuits are designated to work at low pressure and so, the metallic walls could be thin, which represents another way to diminish the thermal resistance.

It is also to be mentioned that the advanced defrost system can diminish the necessary time for defrost. This feature is a direct effect of the new method, because the density of the thermal energy that can be transferred is much higher than for the existing products; as a consequence, the sensor that activates the defrost cycle can be adjusted very close below the designed evaporator temperature, maintaining a good overall efficiency. That result can be easily explained because the above described system can provide an almost instant defrost (because of a higher rate of thermal transfer) and a higher frequency; when a very thin layer of frost should determine a small decrease of the evaporator temperature (below the designed temperature) the sensor will engage the defrost system. It is obvious that the frequency of the defrost cycles should be directly influenced by the ambient level of humidity, the quantity of water evaporated from the products intended to be refrigerated, the frequency of the door opening, etc.

In any case, the advanced defrost system should act much more economically and the energy savings are more relevant when the frequency of the defrost cycles is higher. The features and the parameters of the advanced defrost system lead easily to the necessary arrangements and materials in order to optimize the whole system. Thus, the desired sensible heat capacity for the working liquid can be achieved by a liquid or a homogenous mixture, which has more than 2500 joules/kg/K and comply with the other requirements such as:

low freezing point
non corrosive
non hazardous
non flammable
chemical and physical stability
low viscosity The desired higher than ambient temperature that must be reached and maintained by the working liquid when the compressor runs, leads obviously to the need of an effective insulating wall for the reservoir (5) (see FIG. 3).

Figure 5:
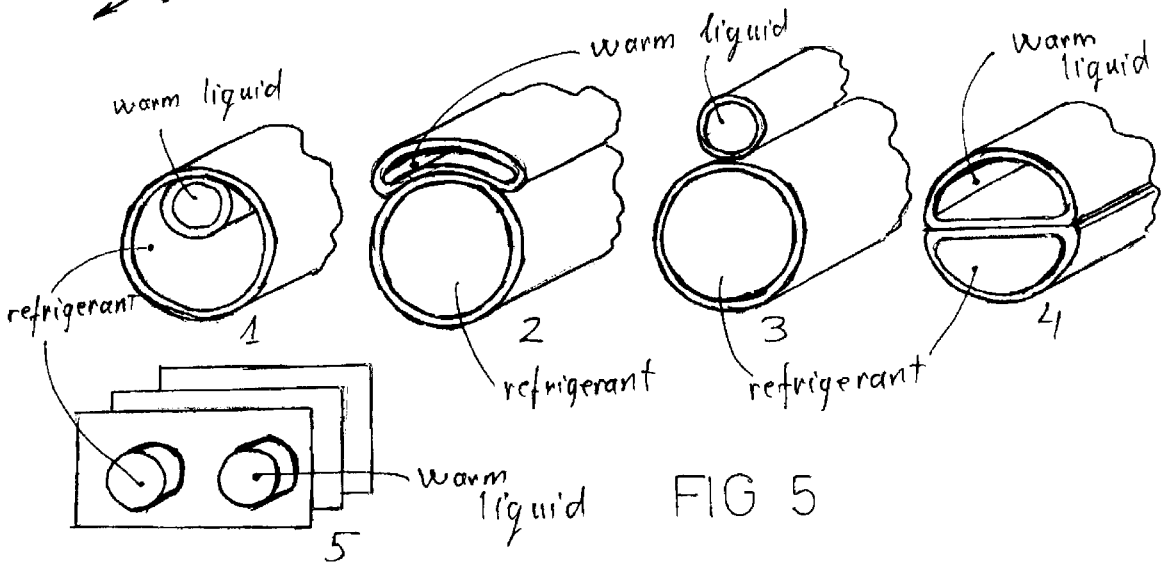
FIG. 5 is a presentation of the anticipated new version for the evaporator design which incorporates the defrost circuit tubes.
Figure 6:
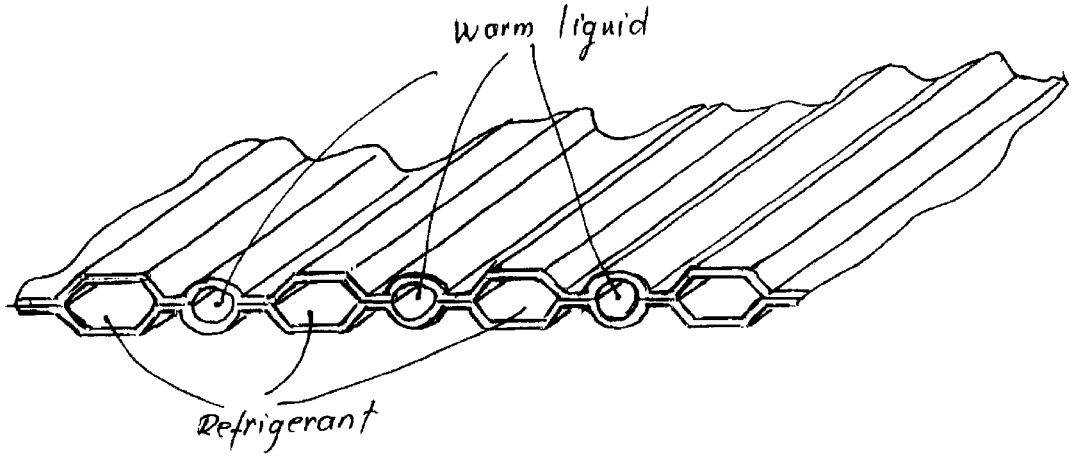
FIG. 6 is a presentation of the proposed new evaporator for small refrigerators which incorporates the defrost circuit: the existing design was not intended to include an active defrost system.
Figure 7:
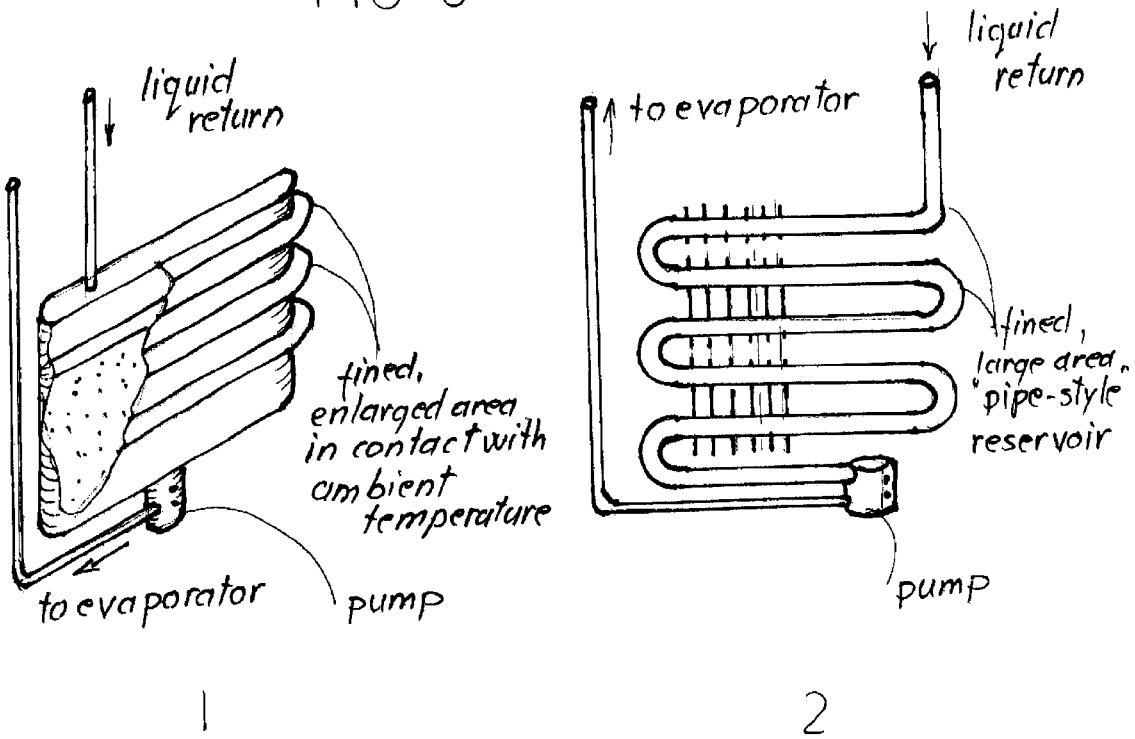
FIG. 7 is a presentation of the anticipated design which uses the liquid at the ambient temperature for the defrost.

In order to enhance the thermal transfer from the liquid to the evaporator coil, the enlarged surface and the thin walls for direst thermal contact and high thermal conductivity materials is the preferred arrangement. As an example, the evaporator shown in FIG. 4 and the details of the thermal contact between the refrigerant and the working liquid circuits, which are presented in FIG. 5 (details 1,2,3,4) is a good approach for the technology expected to be used. Detail no. 4 (FIG. 5) represents the anticipated new design for tubing that will maximize the advanced defrost system's benefits; aluminum or copper are the preferred materials mostly for the evaporator.

The same shape can be used for part of the condenser construction as well.

For convenience the fins are not represented. This new shape of tubing represents a good example for the anticipated "evaporators with incorporated advanced defrost system" which can become reasonably the new standard design. It is also anticipated that similar shape can be used for the high temperature portion of the condenser, in order to provide a fast and effective warming for the working liquid.

All the above mentioned anticipated shapes and design features can be achieved by the conventional technology. It is obvious that for every specific size or specialized refrigeration unit the advanced defrost system may vary in size, volume of the working liquid, the length and the arrangement of the circuits. The best results can be achieved by experiments on a specific size unit, but the basic principles are those presented by this invention.

Referring to the pump 6 (see FIG. 3), any kind of pumping device could be considered. The necessary parameters such as the flow at a specific pressure should be chosen in order to provide the best match with the whole system.

It is anticipated that an immersed magnetic pump rotor that can be driven from the outside fan used for condenser cooling represents a desired and economical approach.

It is also anticipated that a mass production of the new 'refrigeration unit with incorporated advanced defrost system' should represent an important approach to the high-energy efficiency standards for refrigeration and generally for heat pumping units.

What is claimed is:

1. An advanced defrost system for refrigeration that recovers part of the thermal energy expelled by the condenser and uses it to melt the frost deposits during defrost cycle, which comprises:

a) two high efficiency heat exchangers, one attached to the condenser including a reservoir and the other attached to the evaporator and a close loop circuit that permits the circulation of a liquid between the two said heat exchangers;

b) a said reservoir that comprises a high sensible heat liquid, warmed by the hot pressurized refrigerant vapors during normal refrigeration cycle; and c) a pumping unit that can be engaged by a sensor that starts and eventually stops the defrost cycle, which can circulate the said liquid from the reservoir to the evaporator coil in order to melt the frost deposits during defrost cycle.

2. An advanced defrost system for refrigeration that recovers part of the thermal energy expelled by other than condenser hot parts of the refrigeration unit and uses it to melt the frost deposit during defrost cycle, which comprises:

a) two high efficiency heat exchangers, one in thermal contact with the hot part—such as compressor head, compressor casing, compressor lubrication fluid a.s.o., including a reservoir—and the other attached to the evaporator and a closed loop circuit that permits the circulation of a liquid between the two said heat exchangers;

b) a said reservoir that comprises a high sensible liquid, warmed by the said hot part during normal refrigeration cycle; and c) a pumping unit that can be engaged by a sensor that starts and eventually stops the defrost cycle which can circulate the said liquid from the reservoir to the evaporator in order to melt the frost deposits during defrost cycle.

3. An advanced defrost system for refrigeration designed to provide free of charge thermal energy from ambient stored in a high sensible heat liquid and uses it to melt the frost deposits during defrost cycle, which comprises:

a) two high efficiency heat exchanger, one in thermal contact with the ambient including a reservoir and the other attached to the evaporator and a closed loop circuit that permits the circulation of the said liquid between the two said heat exchangers;

b) a said reservoir that comprises the said high sensible heat liquid, warmed by the ambient during normal refrigeration cycle; and c) a pumping unit that can be engaged by a sensor that starts and eventually stops the defrost cycle which can circulate the said liquid from the reservoir from the evaporator coil in order to melt the frost deposits during defrost cycle.

* * * * *